US010993860B2

(12) United States Patent
McNally

(10) Patent No.: US 10,993,860 B2
(45) Date of Patent: May 4, 2021

(54) ROTATIONAL WHEEL CHAIR HAND PEDAL

(71) Applicant: Simon S. McNally, Lancashire (GB)

(72) Inventor: Simon S. McNally, Lancashire (GB)

( * ) Notice: Subject to any disclaimer, the term of this patent is extended or adjusted under 35 U.S.C. 154(b) by 0 days.

(21) Appl. No.: 16/133,718

(22) Filed: Sep. 18, 2018

(65) Prior Publication Data

US 2020/0085649 A1 Mar. 19, 2020

(51) Int. Cl.
*A61G 5/02* (2006.01)

(52) U.S. Cl.
CPC ..... *A61G 5/026* (2013.01); *A61G 5/023* (2013.01)

(58) Field of Classification Search
CPC ..... A61G 5/026; A61G 5/023
See application file for complete search history.

(56) References Cited

U.S. PATENT DOCUMENTS 4,354,691 A * 10/1982 Saunders ..... A61G 5/025 280/244
5,007,655 A * 4/1991 Hanna ..... A61G 5/023 280/245
5,743,544 A * 4/1998 Weaver ..... A61G 5/02 188/2 F
6,007,082 A * 12/1999 Watwood ..... A61G 5/022 188/2 F
6,122,800 A * 9/2000 Cheng ..... A45C 13/262 16/113.1
6,276,703 B1 * 8/2001 Caldwell ..... B62M 1/14 280/211
6,755,430 B1 * 6/2004 Watwood ..... A61G 5/023 280/246
8,657,319 B1 * 2/2014 Cullen ..... A61G 5/023 280/250.1
9,486,372 B2 * 11/2016 Robins ..... A61G 5/125
10,111,789 B2 * 10/2018 McNally ..... A61G 5/023
10,124,666 B2 * 11/2018 Cunningham ..... A61G 5/025

* cited by examiner

*Primary Examiner* — Tony H Winner
*Assistant Examiner* — Harold Eric Pahlck, III
(74) *Attorney, Agent, or Firm* — Ingenium Patents LLC; Peter R. Kramer

(57) ABSTRACT

This invention is a rotational manual propulsion wheel chair hand pedal to be fitted to the axles of both wheels of a wheel chair. The rotational wheel chair hand pedal is attached to the two large wheels of a wheel chair by means of being directly attached to the axles and or hubs securely of the wheel chair's wheels, or surrounding the hubs of the wheel chair's wheels. The rotational wheel chair hand pedal has an arm, which fits from the wheel chair's axle and or hub to the wheel chairs wheel's rim. The position of the handles is fixed by retractable and is adjustable by pressing a button at the end of the handle to retract the pins.

2 Claims, 6 Drawing Sheets

ROTATIONAL WHEEL CHAIR HAND PEDAL

BACKGROUND OF THE INVENTION

Field of the Invention

Figure 1:
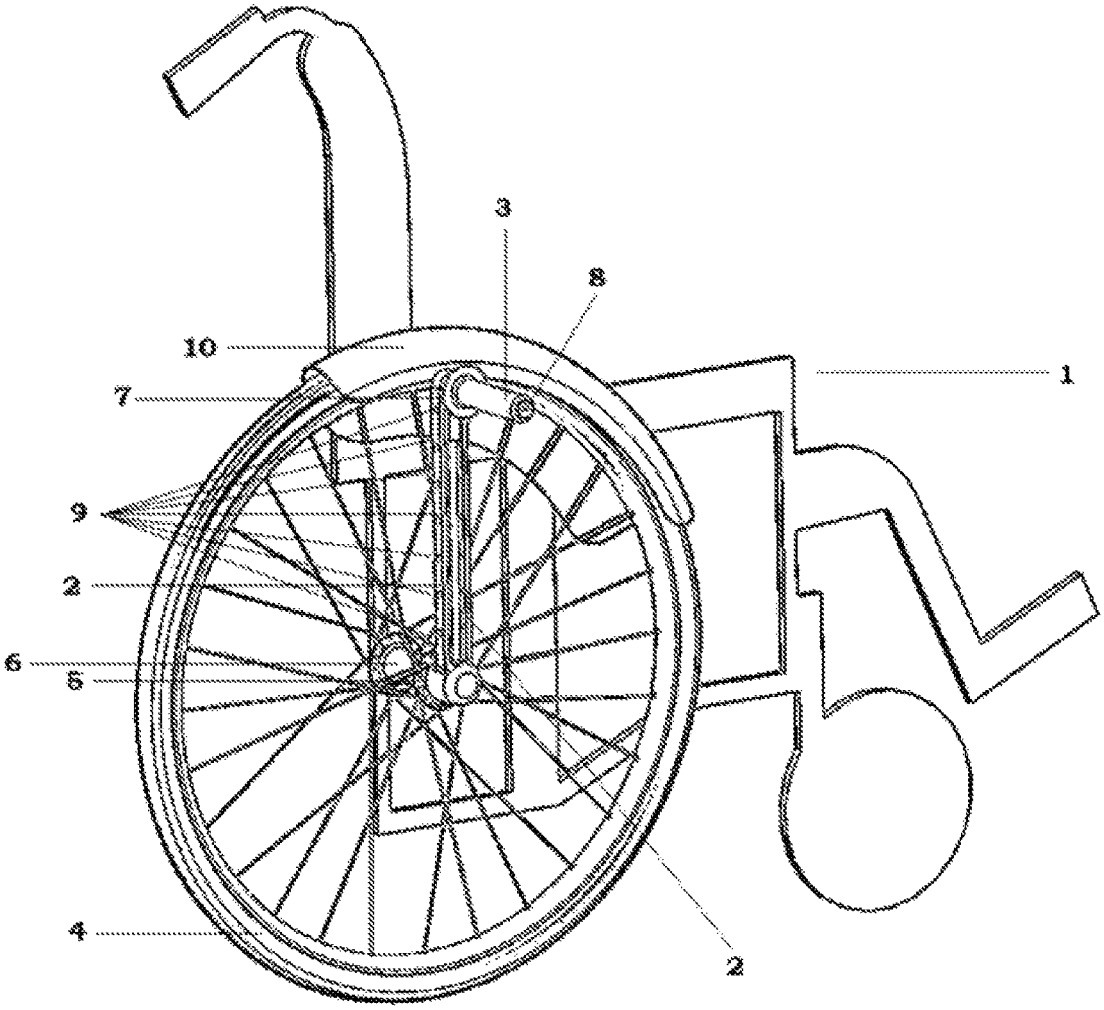

The inventive subject matter of this disclosure relates to manual wheelchair propulsion devices.

Description of Related Art Including Information Disclosed Under 37 CFR 1.97 and 1.98

The related art includes devices that are very complex and therefore expensive. Watwood et al. (U.S. Pat. No. 7,261, 309 B2) is exemplary. Watwood teaches a complex gearing system attached to the wheelchair wheel. It requires complex assembly and due to its complexity its cost is beyond the means of many disabled people.

BRIEF SUMMARY OF THE INVENTION

This invention is a rotational manual propulsion wheel chair hand pedal, to be fitted to the axles of both wheels of the large wheeled wheel chairs on today's market.

Nearly all wheel chair propulsion devices on today's market are attached beyond the outer rim of the wheel chairs wheels and are of push and pull configuration. This is not the case with the hand pedal The rotational wheel chair hand pedal is attached to the two large wheels by means of being directly attached to the axles and or hubs securely of the wheel chair's wheels, or surrounding the hubs of the wheel chair's wheels. Also, it can be directly incorporated into the axles and or hubs of newly manufactured wheel chairs.

The rotational wheel chair hand pedal has an arm, which fits from the wheel chair's axle and or hub to the wheel chairs wheel's rim, this is done, so when the rotational wheel chair hand pedal is not used, it will not hit the ground while still possibly rotating on its own.

Using a wheel chair independently can be virtually impossible to people with limited arm/shoulder movements and very difficult to anyone travelling by wheel chair for long periods of time.

Furthermore, using or pushing a wheel chair up hills or over a long distance is particularly taxing even to persons who are physically fit. The rotational wheel chair hand pedal makes these tasks much easier with different locations for the handle to be moved to within the wheels rim and the axle, this can be moved simply by the press of the button at the end of the handle, this then moves the handle to many different locations within the hand pedals arm. This can be to the tyres rim, or very close to the wheel chair wheel's axle, which with rotational movements either backwards or forwards, propels the person and the wheel chair faster & with more ease. This method can also be used to slow the wheel chair down.

BRIEF DESCRIPTION OF THE SEVERAL VIEWS OF THE DRAWING(S)

FIG. 1—A wheel chair fitted with the hand pedal & hand pedals handle at an extended position.

Figure 2:
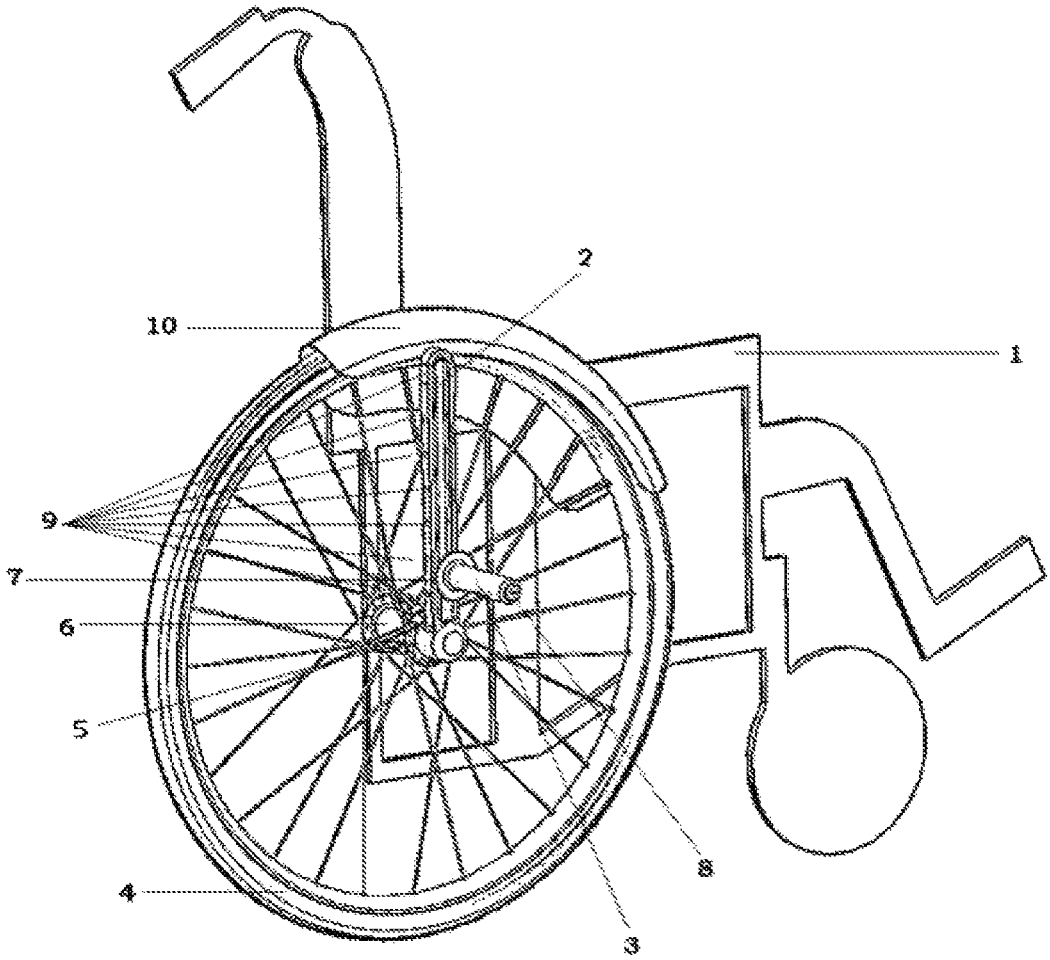

FIG. 2—The hand pedal attached to a wheel chair with the handle partly moved down the hand pedals arm.

Figure 3:
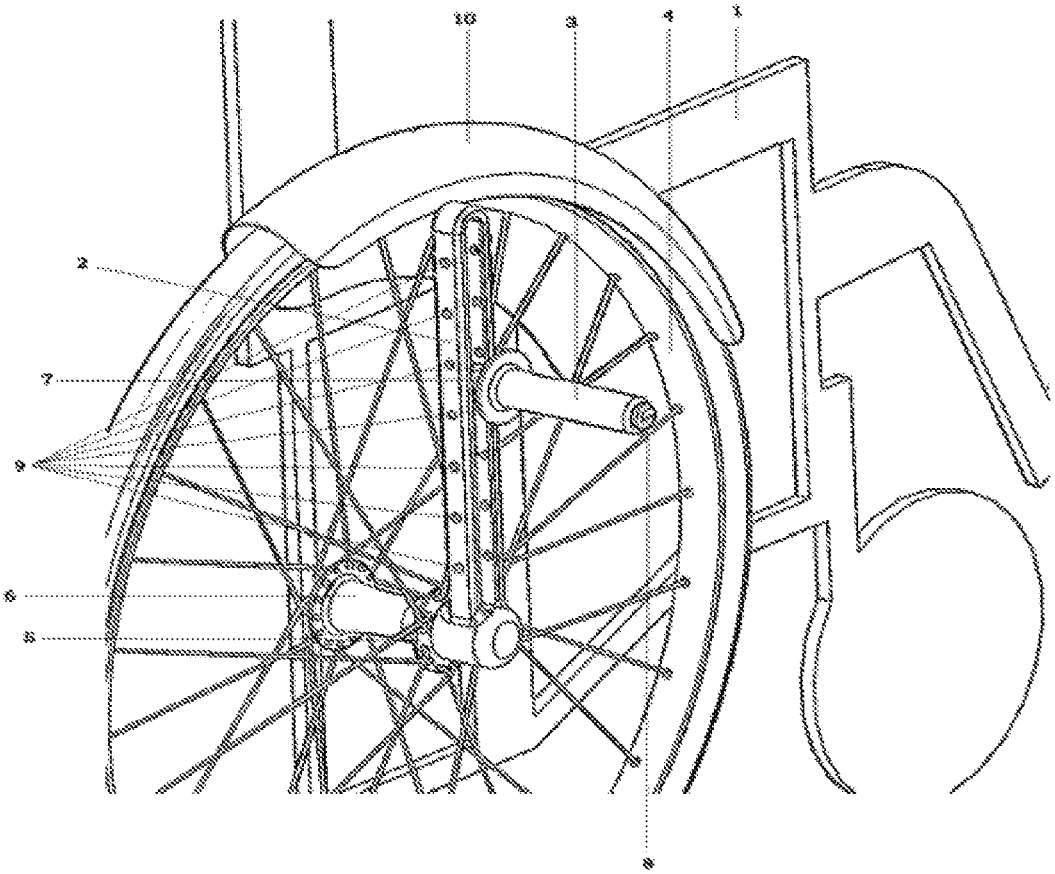

FIG. 3—The hand pedal's handle. When the button is pressed, this retracts the pins and allows the handle to be repositioned within the arm.

Figure 4:
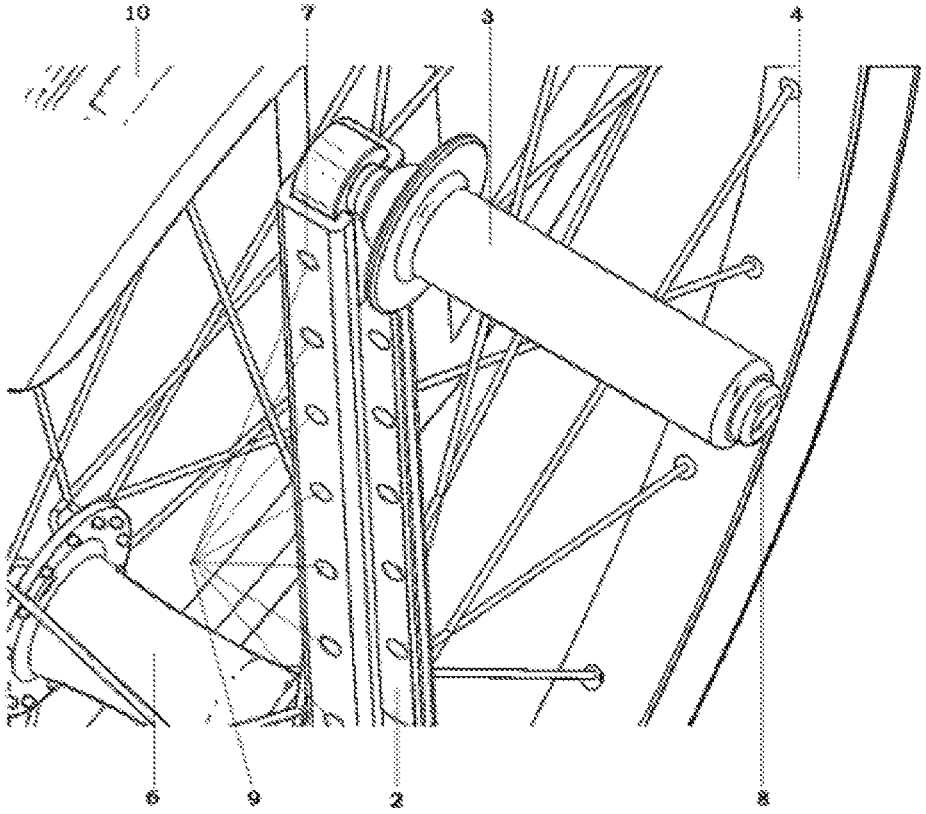

FIG. 4—Partial view of hand pedal on wheel

Figure 5:
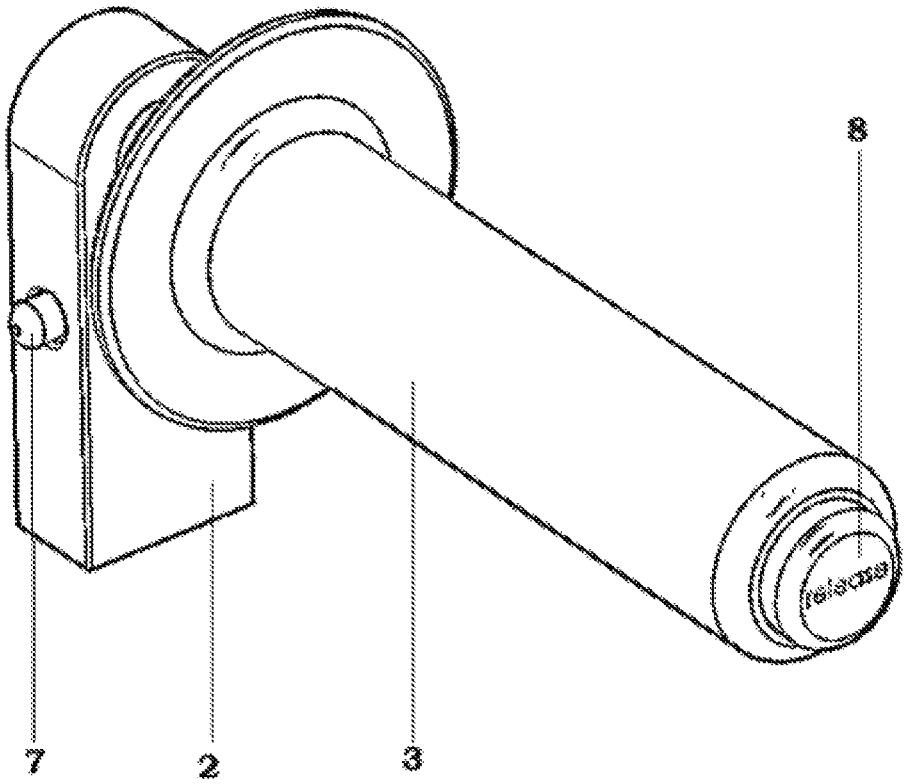

FIG. 5—View of handle showing retractable pin and pin release button

Figure 6:
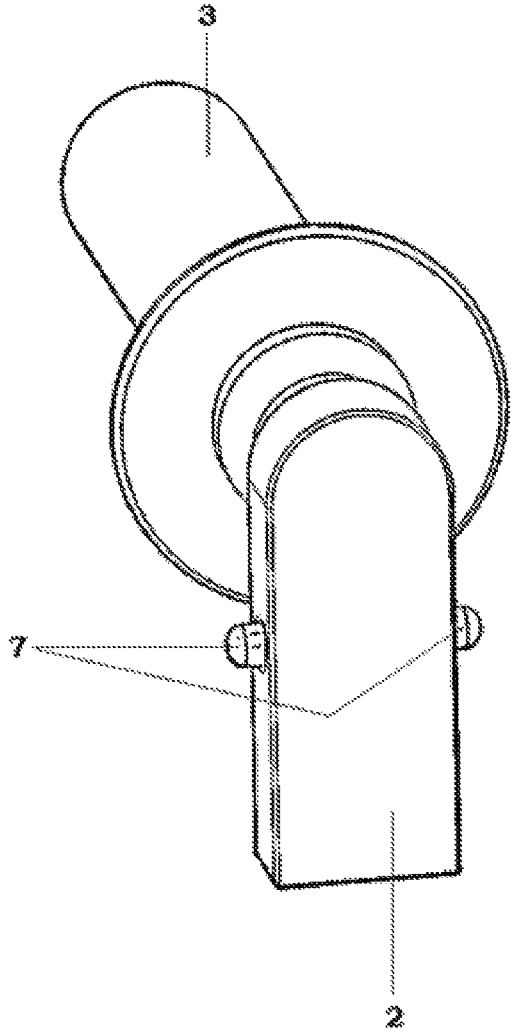

FIG. 6—View of handle showing both retractable pins

REFERENCE NUMERALS IN THE DRAWINGS

1—Profile of Wheel chair.
2. Arm.
3. Handle.
4. Wheel chair's wheel.
5. Axle of wheel chair's wheel.
6. The wheel chair's wheels hub.
7. Retractable pin.
8. Pin release button.
9. Holes positioned along arm to receive pins.
10. Protective guard.

DETAILED DESCRIPTION OF THE INVENTION

The inventive subject matter relates to a rotational manual propulsion wheelchair hand pedal, to be fitted to the axles of both wheels, on large wheeled wheel chairs to both wheels on today's market.

Most of all wheel chairs on today's market are attached beyond the outer rim of the wheel chairs wheel and are of push and pull configuration. This is not the case with the Hand Pedal.

The rotational wheel chair hand pedal is attached to the two large wheels by means of being directly and securely attached to the axle 5 and or hub 6 of the wheel chairs wheel 4, or around the hub 6 of the wheel chair's wheels. It can also be directly incorporated into the axle and or hub of newly manufactured wheel chairs.

The rotational wheel chair hand pedal fits and works within the expanse of the outer wheels tyre rim, this is done so when the rotational wheel chair hand pedal is not used, the hand pedal will not hit the ground while still possibly rotating on its own while not in use.

Using a wheel chair independently can be virtually impossible to people with limited arm/shoulder movements and quite tiresome and difficult to anyone travelling by wheel chair on longer distances.

Furthermore, using or pushing a wheel chair up hills or over a long distance is particularly taxing even to persons who are physically fit. The rotational wheel chair hand pedal makes these tasks much easier with different locations for the handle to be moved along the hand pedal's arm 2, this can be moved simply by the press of a button 8 at the end of the handle. This retracts the pins, so the hand pedals handle can be moved to a new desired location and then the button is released to lock the hand pedals handle in various locations within the hand pedals arm.

The hand pedal handle can be moved within the hand pedal's arm from the tyre's rim, to very close to the wheel chair wheel's axle, which with rotational movements either backwards or forwards, propels the user and the wheel chair more rapidly and with greater ease, whichever maybe comfortable.

The handle of the hand pedal can either be folded, to be flush with the wheel chairs wheel and/or removed easily for convenience in tight spaces.

Pressure applied to the handle of the hand pedal provides force in either forward or reverse directions. With the hand pedal handle moved along the arm, closer to the axle, less motion is required by the user to propel the wheelchair, but more force, and therefore more effort, is required to propel the wheel chairs wheels than when the handle is positioned closer to the tyre. This allows the user to travel with greater velocity on level surfaces. Thus, the hand pedal is adjustable for the user to adapt the device for various terrain conditions and desired velocity according to the user's needs.

Pressure applied to the handle of the hand pedal is transmitted through the arm to provide, rotational force at the wheelchair's hub in either forward or reverse directions. With the hand pedal handle moved along the arm, closer to the axle, less motion is required by the user to propel the wheelchair, but more force, and therefore more effort, is required to propel the wheel chairs wheels than when the handle is positioned closer to the tyre. This allows the user to travel with greater velocity on level surfaces. Thus, the hand pedal is adjustable for the user to adapt the device for various terrain conditions and desired velocity according to the user's needs.

I claim:

1. An apparatus adapted for use on a wheelchair, for a person having at least one hand to propel the wheelchair, the wheelchair having a tyre, a tyre rim, a wheel, a wheel hub (6), and an axle, said apparatus comprising, an arm, a handle, said handle having a portion to accommodate gripping by the person's at least one hand, said handle further having a pin release button, said handle affixed to a slidable base, said slidable base configured to slide within said arm, a retractable pin, said retractable pin positioned in said slidable base, said pin biased to protrude from said base, a plurality of holes, said arm having said plurality of holes along the length of said arm, said holes and said pin configured for said holes to receive said retractable pin when said pin protrudes from said base, said apparatus configured such that by pressing said pin release button said pin retracts into said base, thereby allowing repositioning said handle, a configuration wherein said handle is adjustably positioned between the wheelchair wheel hub and the tyre rim of the wheelchair via sliding movement of said slidable base configured to slide within said arm, said apparatus further configured in which a rotational force is applied at the wheelchair's hub to turn the wheelchair's wheel, wherein a manual force applied at the handle by the person and transmitted through said arm produces the rotational force applied at the wheelchair's hub, thereby turning the wheelchair's wheel.

2. The apparatus according to claim 1 wherein said handle has a long axis parallel to the wheelchair wheel's axle.

* * * * *